US008162636B2

(12) United States Patent
Yokoi et al.

(10) Patent No.: US 8,162,636 B2
(45) Date of Patent: Apr. 24, 2012

(54) SCROLL COMPRESSOR HAVING PARTITION WALL IN OIL RESERVOIR

(75) Inventors: Kenji Yokoi, Kariya (JP); Masao Iguchi, Kariya (JP); Kazuhiro Kuroki, Kariya (JP); Tatsuya Ito, Kariya (JP)

(73) Assignee: Kabushiki Kaisha Toyota Jidoshokki, Aichi-Ken (JP)

( * ) Notice: Subject to any disclaimer, the term of this patent is extended or adjusted under 35 U.S.C. 154(b) by 405 days.

(21) Appl. No.: 12/465,270

(22) Filed: May 13, 2009

(65) Prior Publication Data

US 2009/0285708 A1 Nov. 19, 2009

(30) Foreign Application Priority Data

May 16, 2008 (JP) ..... P2008-128959

(51) Int. Cl.
*F04C 18/00* (2006.01)
*F04C 2/00* (2006.01)

(52) U.S. Cl. ..... 418/55.6; 418/55.5; 418/57; 418/97; 418/270; 418/DIG. 1; 184/6.17; 184/6.27

(58) Field of Classification Search ..... 418/55.1–55.6, 418/57, 88, 92, 94, 97–100, 270, DIG. 1; 184/6.16–6.18, 6.27
See application file for complete search history.

(56) References Cited

U.S. PATENT DOCUMENTS 4,470,778 A * 9/1984 Mabe ..... 418/55.6
6,237,362 B1 * 5/2001 Jang ..... 62/469
7,101,160 B2 9/2006 Gennami et al.
7,140,852 B2 11/2006 Koide et al.
7,264,453 B2 * 9/2007 Gennami et al. ..... 418/55.6
2006/0263227 A1 * 11/2006 Gennami et al. ..... 418/55.6

FOREIGN PATENT DOCUMENTS

JP 10-047283 A 2/1998
JP 2003206861 A * 7/2003
JP 2004301090 A * 10/2004

* cited by examiner

*Primary Examiner* — Theresa Trieu
(74) *Attorney, Agent, or Firm* — Locke Lord LLP

(57) ABSTRACT

A scroll type compressor has a fixed scroll member, a movable scroll member, an oil reservoir, a back-pressure chamber, an oil extraction passage, a flow passage, and a partition wall. The back-pressure chamber disposed behind the movable scroll member is in communication with a discharge chamber. The oil extraction passage having a regulating valve or a throttle connects the back-pressure chamber to the oil reservoir. The oil return passage and the flow passage connect the oil reservoir to a suction chamber, respectively. The flow passage introduces excess lubricating oil into the suction chamber when the level of lubricating oil in the oil reservoir becomes higher than a predetermined level. The partition wall disposed between the openings of the oil extraction passage for restricting lubricating oil from the oil extraction passage other than the excess lubricating oil collected in the oil reservoir from flowing to the flow passage.

9 Claims, 10 Drawing Sheets

SCROLL COMPRESSOR HAVING PARTITION WALL IN OIL RESERVOIR

BACKGROUND OF THE INVENTION

The present invention relates to a scroll type compressor for a vehicle air conditioner.

A motor-driven scroll type compressor for a vehicle air conditioner has a fixed scroll member and a movable scroll member. The fixed scroll member has a scroll wall and a base plate fixed to the housing of the scroll type compressor, and the movable scroll member has a scroll wall and a base plate engaged with the scroll wall of the fixed scroll member. In operation of the scroll type compressor when the movable scroll member is driven by the electric motor to make an orbital motion, the compression chamber formed between the scroll walls of the fixed and movable scroll members is moved toward the center of the scroll walls while reducing its volume for compression of refrigerant.

In the motor-driven scroll type compressor according to the background art disclosed in Japanese Patent Application Publication No. 2004-301090, a back-pressure chamber is formed in the housing behind the base plate of the movable scroll member and also between the movable scroll member and a shaft support member. The back-pressure chamber is in communication with a first oil reservoir formed in the discharge chamber through a pressure oil supply passage. A second oil reservoir is formed in the suction chamber at the outer periphery thereof. The back-pressure chamber is in communication with the second oil reservoir through an oil extraction passage having therein a regulating valve. An oil return passage is formed in the base plate of the fixed scroll member for connecting the second oil reservoir to the suction chamber formed in the housing on the outer peripheral side of the scroll walls or on the rear side. A gas return passage is formed in the housing for connecting the upper region of the second oil reservoir to the upper region of the suction chamber.

The regulating valve is operable to open and close in accordance with the pressure in the back-pressure chamber, and high-pressure refrigerant gas and lubricating oil are introduced into the second oil reservoir from the back-pressure chamber through the oil extraction passage. The lubricating oil in the second oil reservoir is introduced into the suction chamber through the oil return passage to lubricate sliding surfaces of the compressor. Refrigerant gas separated from the lubricating oil in the second oil reservoir is introduced into the suction chamber through the gas return passage.

According to the background art disclosed in the above Publication, when the amount of the lubricating oil reserved in the second oil reservoir is increased, there arises a problem that the lubricating oil may overflow from the second oil reservoir. In order to solve the above problem, there has been proposed a compressor having a flow passage connecting the oil reservoir to the suction chamber so that any excess lubricating oil in the oil reservoir is returned to the suction chamber through this flow passage when the level of the lubricating oil in the oil reservoir becomes higher than a predetermined level. In this compressor, the flow passage is formed in the oil reservoir at a position higher than the oil return passage. Thus, when the level of lubricating oil in the oil reservoir exceeds the level of the flow passage, excess lubricating oil is introduced into the suction chamber through the flow passage, thus the amount of lubricating oil to be reserved in the reservoir being adjustable so as to maintain a predetermined amount.

According to the above background art, high-pressure refrigerant gas and lubricating oil introduced into the oil reservoir from the back-pressure chamber through the oil extraction passage are dispersed therearound by strong jetting force. A part of the dispersed lubricating oil is directly flowed into the flow passage with refrigerant gas, and then introduced into the suction chamber. As a result, only a small amount of lubricating oil is collected in the oil reservoir and, therefore, the oil rate of the refrigerant circuit, i.e. the circulation efficiency of the lubricating oil in the refrigerant circuit, may be increased. This causes an increase of pressure loss and a reduction of heat exchanging efficiency, with the result that the system performance of the compressor deteriorates.

The present invention is directed to providing a scroll type compressor which prevents lubricating oil flowed from the back-pressure chamber to the oil reservoir through the oil extraction passage from flowing directly into the flow passage.

SUMMARY OF THE INVENTION

In accordance with the present invention, a scroll type compressor has a housing, a rotary shaft, a discharge chamber and a suction chamber. The scroll type compressor has a fixed scroll member, a movable scroll member, an oil reservoir, a back-pressure chamber, an oil extraction passage, a flow passage, and a partition wall. The fixed scroll member is fixed to the housing. The movable scroll member compresses refrigerant gas flowed from the suction chamber by the orbital movement of the movable scroll member due to the rotation of the rotary shaft and discharges the compressed refrigerant gas. The movable scroll member is disposed in facing relation to the fixed scroll member. The oil reservoir collects lubricating oil, and is disposed in the housing. The back-pressure chamber is in communication with the discharge chamber, and is disposed behind the movable scroll member. The oil extraction passage connects the back-pressure chamber to the oil reservoir, and has a regulating valve or a throttle. The oil return passage connects the oil reservoir to the suction chamber. The flow passage connects the oil reservoir to the suction chamber, and introduces excess lubricating oil into the suction chamber when the level of lubricating oil in the oil reservoir becomes higher than a predetermined level. The partition wall is disposed between the openings of the oil extraction passage and the flow passage for restricting lubricating oil from the oil extraction passage other than the excess lubricating oil reserved in the oil reservoir from flowing to the flow passage.

Other aspects and advantages of the invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention together with objects and advantages thereof, may best be understood by reference to the following description of the presently preferred embodiments together with the accompanying drawings in which:

DETAILED DESCRIPTION OF THE PREFERRED EMBODIMENTS

Figure 1:
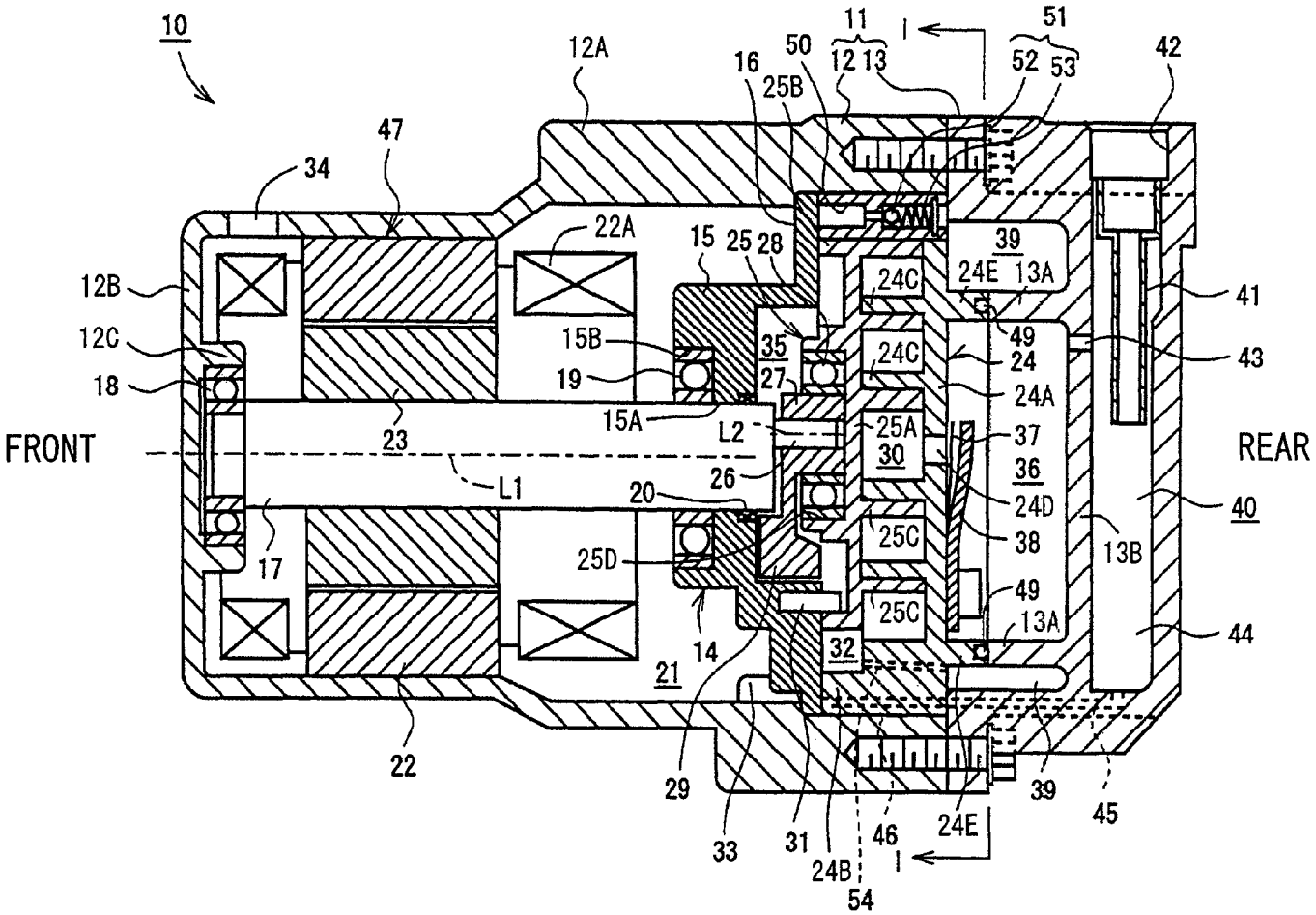
FIG. 1 is a longitudinal cross-sectional view of a scroll type compressor according to a first preferred embodiment of the present invention.

The following will describe a motor-driven scroll type compressor according to the first preferred embodiment of the present invention. The motor-driven scroll type compressor (hereinafter referred to merely as "compressor") of the first preferred embodiment forms a part of a refrigerant circuit of a vehicle air conditioner. Referring to FIG. 1, a compressor 10 has a housing 11 including a front housing 12 and a rear housing 13 jointed to the front housing 12 by means of a blot. The front housing 12 includes a cylindrical portion 12A and a bottom portion 12B closing the front end of the cylindrical portion 12A. The left and right sides of the compressor 10 as seen in FIG. 1 correspond to its front and rear sides. The upper and lower sides of the compressor 10 as seen in FIG. 1 correspond to its upper and lower side. The rear housing 13 has a cover shape having therein a plurality of spaces formed by partition walls, and covers the opened rear end of the front housing 12.

An annular rib 12C is formed in the front housing 12, extending rearward from the center of the inner surface of the bottom portion 12B thereof. A shaft support 14 is accommodated in and fixed to the front housing 12 adjacent to the opening thereof. The shaft support 14 has a cylindrical portion 15 and a flange portion 16. The cylindrical portion 15 of the shaft support 14 has a hole 15A and a bearing receiving portion 15B, and the flange portion 16 extends radially from the rear end of the cylindrical portion 15. The flange portion 16 is press-fitted at the outer periphery thereof to the inner wall of the cylindrical portion 12A of the front housing 12. Thus, the inner space of the front housing 12 is divided into two spaces, namely front and rear spaces by the shaft support 14.

A rotary shaft 17 is arranged in the front housing 12. One end of the rotary shaft 17 is rotatably supported by a bearing 18 received in the rib 12C. While the other end of the rotary shaft 17 is rotatably supported by a bearing 19 accommodated in the bearing receiving portion 15B of the shaft support 14. A seal member 20 is disposed between the shaft support 14 and the rotary shaft 17 for sealing the rotary shaft 17. The front of the inner space of the front housing 12 provides a motor chamber 21 in which a stator 22 is fixed along the inner surface of the motor chamber 21. A rotor 23 is fixedly mounted to the rotary shaft 17 in the motor chamber 21 in facing relation to the stator 22. The stator 22 and the rotor 23 cooperate to form an electric motor 47 of the compressor 10 and electric power is supplied to a coil 22A of the stator 22 to rotate the rotary shaft 17 and the rotor 23 integrally.

A fixed scroll member 24 is accommodated in the inner space of the front housing 12 on the rear side thereof, and fixed to the front housing 12 so as to be located closer to the opening of the front housing 12 than the shaft support 14. A movable scroll member 25 orbiting by the rotation of the rotary shaft 17 is disposed between the fixed scroll member 24 and the shaft support 14. The fixed scroll member 24 has a disc-shaped fixed base plate 24A, an outer peripheral wall 24B, and a fixed scroll wall 24C. The outer peripheral wall 24B extends from the front surface of the outer periphery of the fixed base plate 24A, and the fixed scroll wall 24C extends from the front surface of the fixed base plate 24A radially inward of the outer peripheral wall 24B. The outer peripheral wall 24B is connected at the distal end thereof to the outer periphery of the flange portion 16 of the shaft support 14.

The rotary shaft 17 has at the rear end thereof a crankshaft 26 having an axis L2 extending rearward in offset relation to an axis L1 of the rotary shaft 17. A cylindrical bushing 27 is fitted over the crankshaft 26. The movable scroll member 25 is rotatably supported by the bushing 27 through a bearing 28 in facing relation to the fixed scroll member 24. The bushing 27 is provided with a balancer 29 for reducing the imbalance of the rotary shaft 17 due to the offset arrangement of the movable scroll member 25

The movable scroll member 25 has a disk-shaped movable base plate 25A, an outer peripheral wall 25B, a movable scroll wall 25C, and a bearing receiving portion 25D. The outer peripheral wall 25B extends from the outer periphery of the movable base plate 25A, and the movable scroll wall 25C extends from the rear surface of the movable base plate 25A radially inward of the outer peripheral wall 25B. The bearing 28 is accommodated in the bearing receiving portion 25D. The movable scroll wall 25C of the movable scroll member 25 and the fixed scroll wall 24C of the fixed scroll member 24 are engaged with each other in such a way that the movable scroll wall 25C is in slide contact at the distal end thereof with the fixed base plate 24A and the fixed scroll wall 24C is in slide contact at the distal end thereof with the movable base plate 25A. Thus, a compression chamber 30 is formed between the fixed scroll member 24 and the movable scroll member 25. Specifically, the compression chamber 30 is defined by the fixed base plate 24A, the movable base plate 25A, the fixed scroll wall 24C and the movable scroll wall 25C. The flange portion 16 of the shaft support 14 is in slide contact with the front surface of the outer peripheral wall 25B of the movable scroll member 25. A plurality of pins 31 are arranged between the flange portion 16 and the movable scroll member 25 for preventing the movable scroll member 25 from rotating on its own axis.

A suction chamber 32 forming a part of a suction-pressure region of the compressor 10 is defined by the outer peripheral wall 24B of the fixed scroll member 24, the outer peripheral wall 25B of the movable scroll member 25, and the flange portion 16 of the shaft support 14. A suction passage 33 is formed in the front housing 12 on the lower side thereof for connecting the motor chamber 21 and the suction chamber 32. A suction port 34 is formed in the front housing 12 at a position adjacent to the front end thereof for communication between the motor chamber 21 and the lower pressure side of the external refrigerant circuit (not shown) in which the compressor 10 is connected. During the operation of the compressor 10, low-pressure refrigerant gas is introduced into the suction chamber 32 through the suction port 34, the motor chamber 21 and the suction passage 33. A back-pressure chamber 35 is formed in the front housing 12 and defined by the shaft support 14, the movable base plate 25A and the outer peripheral wall 25B of the movable scroll member 25.

The rear housing 13 has a cylindrical partition wall 13A and an end wall 13B formed at the rear end of the partition wall 13A so that the cylindrical partition wall 13A forms a space that is open toward the fixed scroll member 24. With the rear housing 13 jointed to the front housing 12, a discharge chamber 36 is formed between the rear housing 13 and the fixed scroll member 24. Specifically, the discharge chamber 36 is defined by the partition wall 13A, the end wall 13B, the fixed base plate 24A, and an annular partition wall 24E extending rearward from the fixed base plate 24A. An oil reservoir 39 for collecting lubricating oil is formed in the rear housing 13 around the partition wall 13A or between the entire outer periphery of the discharge chamber 36 and an outer cylindrical portion 13C of the rear housing 13 so as to surround the discharge chamber 36, as shown in FIGS. 1 and 2.

Figure 2:
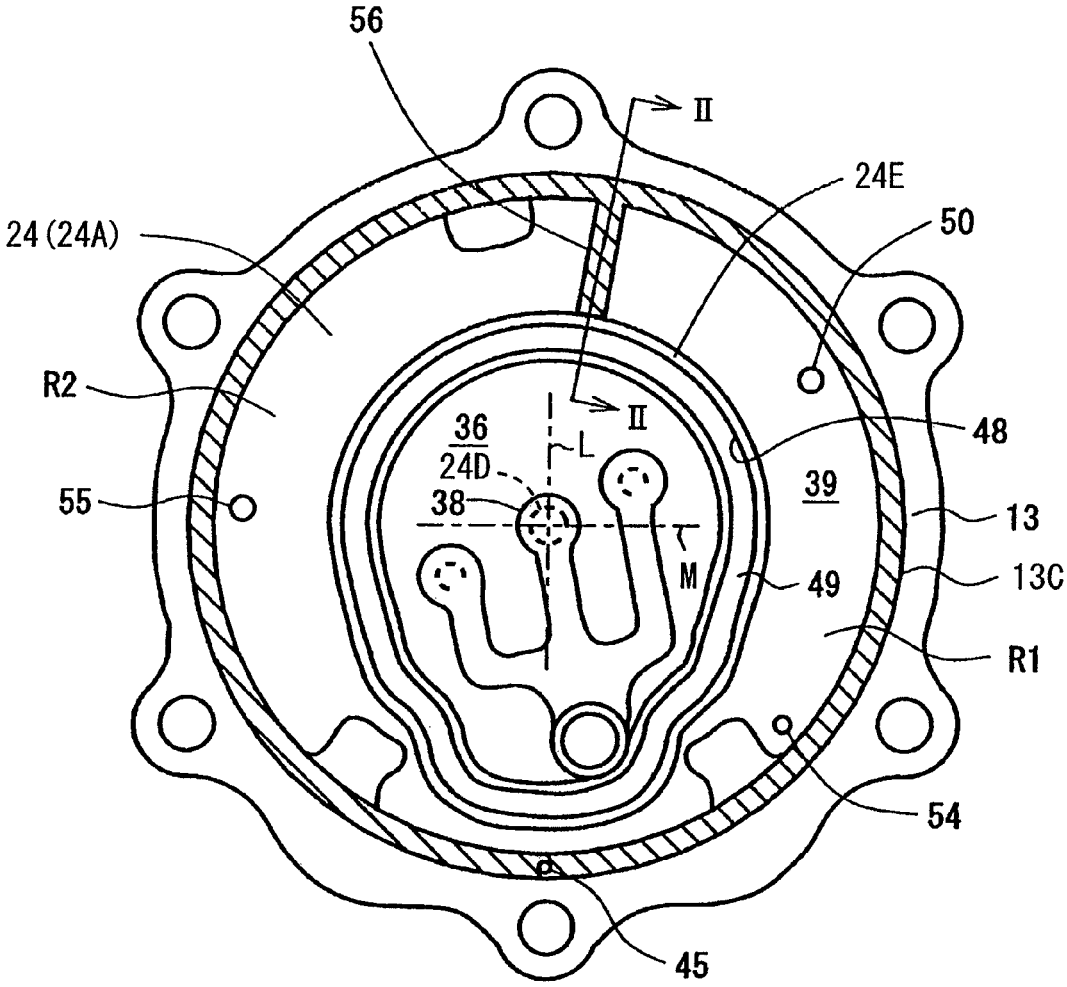
FIG. 2 is a transverse cross-sectional view taken along the line I-I in FIG. 1.

The closed annular partition wall 24E is formed integrally with the fixed base plate 24A of the fixed scroll member 24 on the rear side thereof, as shown in FIGS. 1 and 2. The partition wall 13A and the partition wall 24E are formed in the rear housing 13 in facing relation to each other. A groove 48 is formed in the partition wall 24E at the distal end thereof. A seal ring 49 is fitted in the groove 48 for sealing between the partition wall 13A and the partition wall 24E. The seal ring 49 prevents the refrigerant gas discharged in the discharge chamber 36 from leaking to the oil reservoir 39.

A hole 24D is formed through the fixed base plate 24A of the fixed scroll member 24 at the center thereof. The compression chamber 30 at the center of the fixed base plate 24A is in communication with the discharge chamber 36 through the hole 24D. A discharge valve 37 made of a reed valve is arranged to the fixed scroll member 24 in the discharge chamber 36 for opening and closing the hole 24D. Opening of the discharge valve 37 is regulated by a retainer 38 which is fixedly mounted to the fixed scroll member 24.

In operation of the compressor 10 when the rotary shaft 17 is being rotated by the electric motor 47, the movable scroll member 25 orbits around the axis of the fixed scroll member 24 or the axis L1 of the rotary shaft 17 through the crankshaft 26. The pins 31 prevent the movable scroll member 25 from rotating on its own axis, allowing the movable scroll member 25 only to orbit. This causes the compression chamber 30 to be moved radially and inwardly from the outer peripheral side of the fixed and movable scroll walls 24C, 25C of the fixed and movable scroll members 24, 25 toward the center thereof while reducing gradually the volume thereof, so that refrigerant gas introduced from the suction chamber 32 into the compression chamber 30 is compressed. The refrigerant gas thus compressed is discharged into the discharge chamber 36 through the hole 24D and the discharge valve 37.

An accommodation chamber 40 having a cylindrical shape extending vertically is formed in the rear housing 13 and located rearward of the end wall 13B. An oil separator 41 is disposed in the accommodation chamber 40 for separating lubricating oil from refrigerant gas. A discharge port 42 is formed in the accommodation chamber 40 on the upper side of the oil separator 41 for communication with the high-pressure side of the external refrigerant circuit (not shown). The discharge chamber 36 and the accommodation chamber 40 are in communication with each other through a communication passage 43 which is formed in the end wall 13B.

Thus, high-pressure refrigerant gas in the discharge chamber 36 is introduced into the accommodation chamber 40 through the communication passage 43. Then, lubricating oil is separated from the high-pressure refrigerant gas by the oil separator 41, and the refrigerant gas after the oil separation is discharged to the external refrigerant circuit through the discharge port 42. The lubricating oil separated by the oil separator 41 is collected in an oil reserve portion 44 which is located at the bottom of and a part of the accommodation chamber 40. A communication passage 45 is formed in the rear housing 13 so as to extend from the bottom of the oil reserve portion 44. A communication passage 46 is formed in the outer peripheral wall 24B of the fixed scroll member 24 in communication with the communication passage 45. The oil reserve portion 44 is in communication with the back-pressure chamber 35 through the communication passages 45, 46. The communication passages 45, 46 forms a part of a bleed passage. Lubricating oil collected in the oil reservoir 44 is supplied through the bleed passage to the back-pressure chamber 35 whose pressure is lower than that of the accommodation chamber 40.

An oil extraction passage 50 is formed in the outer peripheral wall 24B of the fixed scroll member 24, extending in the longitudinal direction of the compressor 10. The oil reservoir 39 is in communication with the back-pressure chamber 35 through the oil extraction passage 50. A regulating valve 51 is disposed in the oil extraction passage 50 for adjusting the opening of the oil extraction passage 50 in accordance with the pressure difference between the back-pressure chamber 35 and the oil reservoir 39. The regulating valve 51 includes a ball valve 52 and a coil spring 53, and is operated so as to maintain the pressure difference between the back-pressure chamber 35 and the oil reservoir 39 substantially constant. Thus, the force urging the movable scroll member 25 toward the fixed scroll member 24 due to the pressure in the back-pressure chamber 35 is maintained substantially constant by the operation of the regulating valve 51. Lubricating oil in the back-pressure chamber 35 is introduced into the oil reservoir 39 through the oil extraction passage 50 and the regulating valve 51, and collected in the oil reservoir 39.

An oil return passage 54 is formed in the fixed base plate 24A of the fixed scroll member 24 for connecting the lower part of the oil reservoir 39 to the suction chamber 32, as shown in FIG. 2. A flow passage 55 is formed in the fixed base plate 24A of the fixed scroll member 24 for introducing excess lubricating oil in the oil reservoir 39 into the suction chamber 32. Referring to FIG. 2, L designates a vertical line passing through the center of the oil reservoir 39 of the compressor 10 as seen in the transverse cross-section thereof and M designates a horizontal line passing through the same center. As shown in FIG. 2, the flow passage 55 is formed at a position that is on the opposite side of the vertical line L from the oil extraction passage 50 or on the left side on the drawing and also at a position that is slightly higher than the horizontal line M, and the oil return passage 54 is formed at a position below the horizontal line M.

Thus, lubricating oil collected in the oil reservoir 39 is introduced into the suction chamber 32 through the oil return passage 54 by a vacuum force generated by the orbital motion of the movable scroll member 25. Then, the lubricating oil is introduced into the compression chamber 30 with refrigerant gas and lubricates sliding surfaces of the compression chamber 30. When the level of the lubricating oil in the oil reservoir 39 becomes too high, the excess lubricating oil is introduced into the suction chamber 32 through the flow passage 55, so that the level of the lubricating oil in the oil reservoir 39 is maintained at an appropriate level.

The oil reservoir 39 surrounding the discharge chamber 36 has an annular space as shown in FIG. 2. Thus, the opening of the oil extraction passage 50 at the annular space of the oil reservoir 39 and the opening of the flow passage 55 at the same annular space are connected to each other through regions R1, R2, as shown in FIG. 2. That is, the region R1 is a region of the annular space that is located below the opening of the flow passage 55 and includes the opening of the oil return passage 54, and the region R2 is a region of the annular space that is located above the opening of the flow passage 55 and does not include the opening of the oil return passage 54. The region R1 corresponds to a communication passage extending in clockwise direction and connecting the opening of the oil extraction passage 50 to the opening of the flow passage 55. The region R2 corresponds to a communication passage extending in opposite counter-clockwise direction and connecting the opening of the oil extraction passage 50 to the opening of the flow passage 55.

Figure 3:
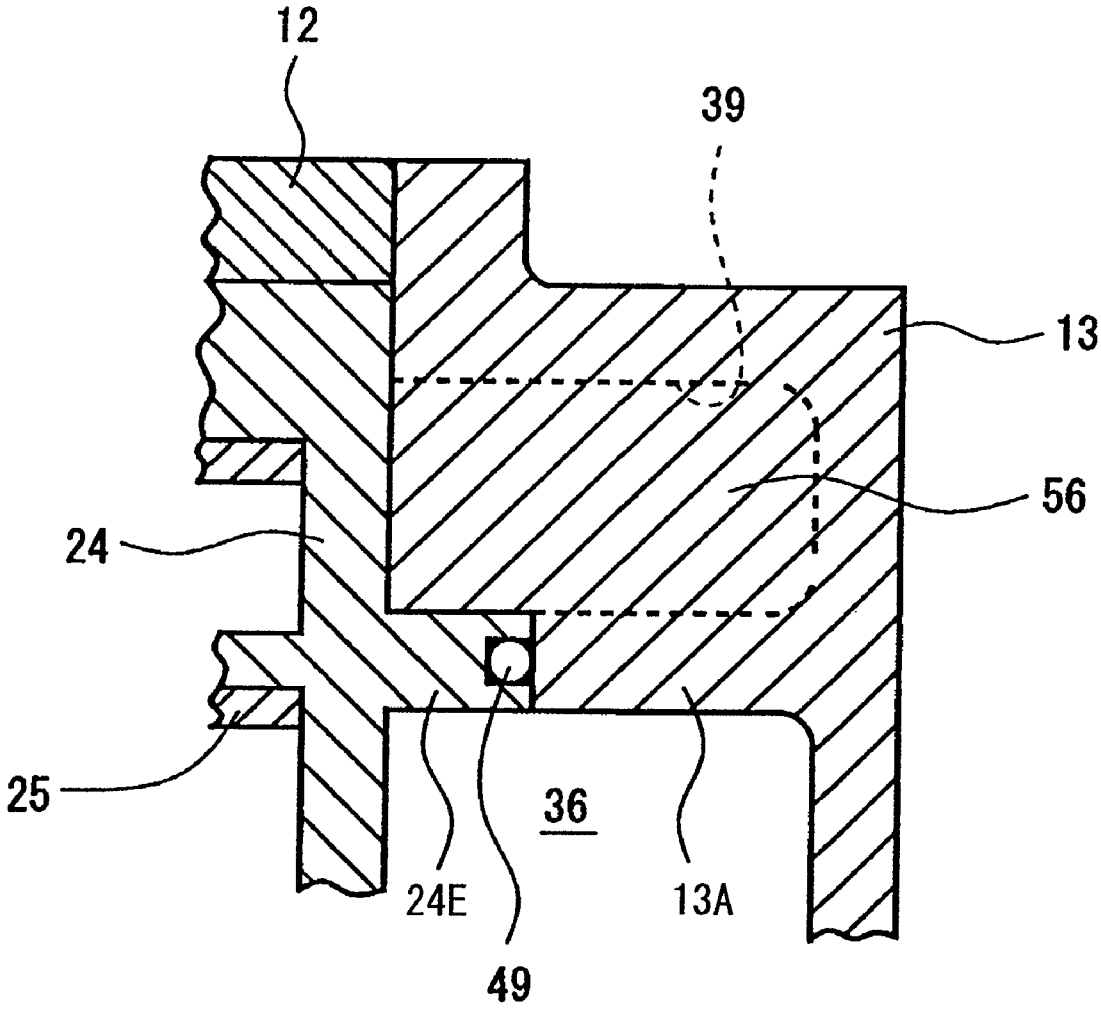
FIG. 3 is a partially enlarged cross-sectional view of a partition wall taken along the line II-II in FIG. 2.

A partition wall 56 is disposed in the oil reservoir 39 between the opening of the oil extraction passage 50 and the opening of the flow passage 55. The partition wall 56 restricts flow of lubricating oil from the oil extraction passage 50 other than excess lubricating oil collected in the oil reservoir 39 from flowing from the flow passage 55 to the suction chamber 32. In other words, the partition wall 56 functions such that the excess lubricating oil flows from the flow passage 55 to the suction chamber 32. The partition wall 56 is disposed in the region R2 which is located above the opening of the flow passage 55 and does not include the opening of the oil return passage 54. As shown in FIGS. 2 and 3, the partition wall 56 is formed extending from the outer peripheral cylindrical portion 13C of the rear housing 13 toward the partition wall 24E to such an extent that the partition wall 56 is in contact at the distal end thereof with the partition wall 24E. The opening of the flow passage 55 is located above the opening of the oil return passage 54, wherein the opening of the flow passage 55 is located below the partition wall 56. The outer peripheral cylindrical portion 13C corresponds to the outer peripheral wall of the oil reservoir 39, and the partition wall 24E divides a part of the inner space of the rear housing 13 into the discharge chamber 36 and the oil reservoir 39. The region R2 is partitioned and closed by the partition wall 56, which prevents lubricating oil introduced through the opening of the oil extraction passage 50 from being flowed directly into the opening of the flow passage 55 through the region R2.

The following describe the operation of the compressor 10 constructed as described above. When the electric motor 47 of the compressor 10 is energized, the rotor 23 and the rotary shaft 17 are rotated integrally. As the rotary shaft 17 is rotated, the movable scroll member 25 orbits without being rotated on its own axis, thus suctioning the refrigerant gas into the compression chamber 30 and then compressing therein the refrigerant gas. In this operation, low-pressure refrigerant gas is introduced from the external refrigerant circuit into the suction chamber 32 through the suction port 34, the motor chamber 21, and the suction passage 33. During the compression, the refrigerant gas is compressed by reduction of the volume of the compression chamber 30. Then, the compressed high-pressure refrigerant gas opens the discharge valve 37 and is discharged to the external refrigerant circuit through the hole 24D, the discharge chamber 36, the accommodation chamber 40, the oil separator 41, the discharge port 42. Lubricating oil is separated from refrigerant gas by the oil separator 41 and the separated lubricating oil falls down and is collected in the oil reserve portion 44.

The lubricating oil collected in the oil reserve portion 44 of the accommodation chamber 40 is supplied with a small amount of refrigerant gas in the accommodation chamber 40 through the communication passages 45, 46 to the back-pressure chamber 35 whose pressure is lower than that of the accommodation chamber 40. Then, the pressure in the back-pressure chamber 35 is raised thereby to urge the movable scroll member 25 toward the fixed scroll member 24. The back-pressure chamber 35 is in communication with the oil reservoir 39 through the oil extraction passage 50 and the regulating valve 51, so that the pressure in the back-pressure chamber 35 is maintained substantially at a constant level by the operation of the regulating valve 51.

If the pressure in the back-pressure chamber 35 becomes too high, the ball valve 52 of the regulating valve 51 is moved against the urging force of the coil spring 53 thereby to open the regulating valve 51, so that the oil extraction passage 50 is opened. Lubrication oil in the back-pressure chamber 35 is introduced into the oil reservoir 39 with a small amount of refrigerant gas through the opening of the oil extraction passage 50 by strong jetting force generated by the pressure difference between the back-pressure chamber 35 and the oil reservoir 39.

Figure 4:
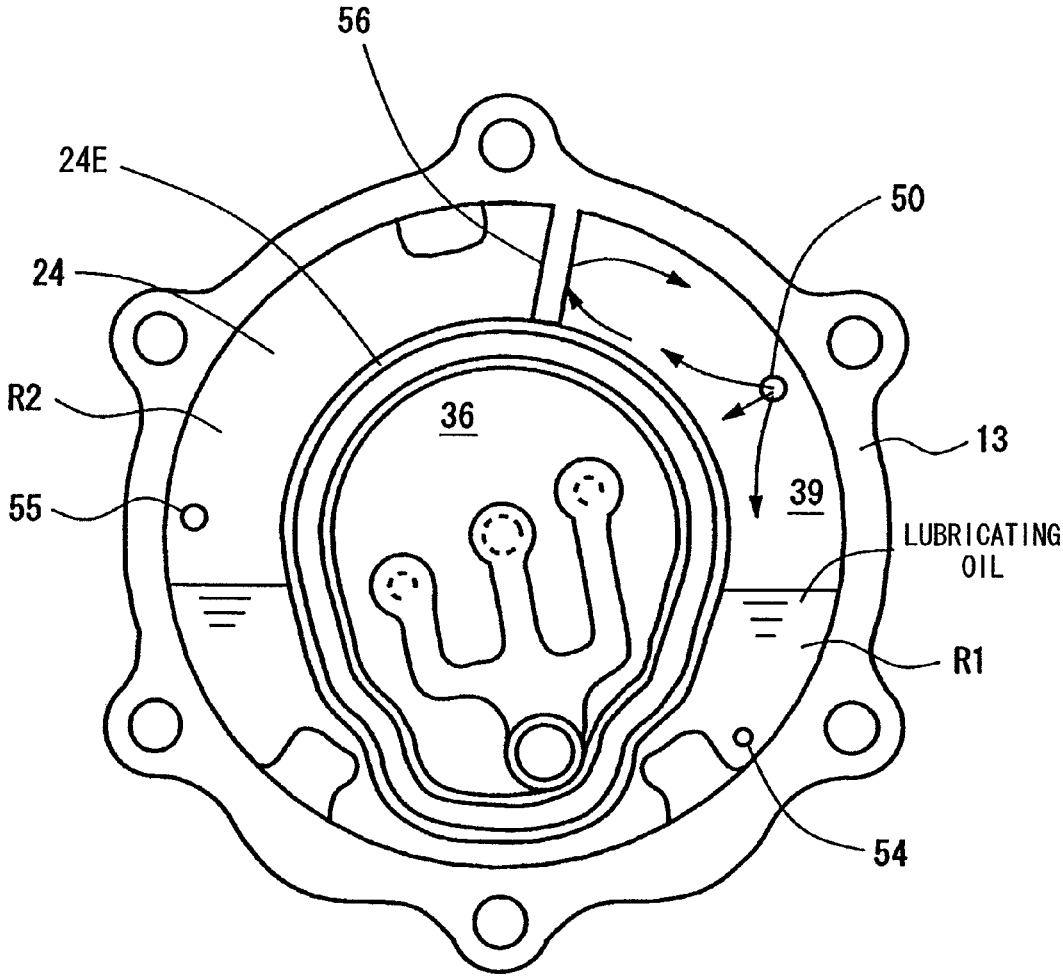
FIG. 4 is a schematic view illustrating the operation of the compressor according to the first preferred embodiment of the present invention.

Referring to FIG. 4, high-pressure lubricating oil is jetted from the opening of the oil extraction passage 50 and dispersed therearound. The lubricating oil jetted upward in the oil reservoir 39 impinges on the partition wall 56 disposed in the region R2 and changes its moving direction. Then, the lubricating oil falls toward the opening of the oil return passage 54 to be collected at the bottom of the oil reservoir 39. Meanwhile, the lubricating oil jetted downward in the oil reservoir 39 falls directly toward the opening of the oil return passage 54 and collected at the bottom portion of the oil reservoir 39. Thus, the provision of the partition wall 56 between the opening of the oil extraction passage 50 and the opening of the flow passage 55 in the oil reservoir 39 prevents lubricating oil jetted from the opening of the oil extraction passage 50 from being directly flowed into the flow passage 55.

Lubricating oil in the oil reservoir 39 is introduced into the suction chamber 32 through the oil return passage 54 by a vacuum force generated by the orbital motion of the movable scroll member 25 relative to the fixed scroll member 24. Then, the lubricating oil is introduced into the compression chamber 30 with refrigerant gas and lubricates sliding surfaces of the compression chamber 30. When the level of the lubricating oil in the oil reservoir 39 becomes higher and exceeds the level of the flow passage 55, excess lubricating oil is introduced into the suction chamber 32 through the flow passage 55, so that the level of the lubricating oil in the oil reservoir 39 is maintained at an appropriate level.

The following advantageous effects are obtained according to the compressor 10 of the first preferred embodiment.

(1) The partition wall 56 is arranged in the oil reservoir 39 between the openings of the oil extraction passage 50 and the flow passage 55 and in the region R2 which is located above the opening of the flow passage 55 and does not include the opening of the oil return passage 54. This prevents lubricating oil jetted from the opening of the oil extraction passage 50 from passing through the region R2 and being flowed directly into the opening of the flow passage 55. When the level of the lubricating oil in the oil reservoir 39 becomes higher and exceeds the level of the flow passage 55, the excess lubricating oil is introduced into the suction chamber 32 through the flow passage 55. Thus, the level of lubricating oil in the oil reservoir 39 can be maintained at an appropriate level. Therefore, an increase of oil rate of the refrigerant circuit may be suppressed, thereby improving the system performance of the compressor 10.

(2) The partition wall 56 is formed extending from the outer peripheral cylindrical portion 13C of the rear housing 13 toward the partition wall 24E defining the discharge chamber 36 to such an extent that the partition wall 56 is in contact at the distal end thereof with the partition wall 24E, thereby completely preventing lubricating oil from flowing from the opening of the oil extraction passage 50 directly to the opening of the flow passage 55. The partition wall 56 is formed integrally with the rear housing 13 and, therefore, there is no need to prepare an additional part for the partition wall 56, which is advantageous in reducing the manufacturing processes and cost of the compressor.

Figure 5:
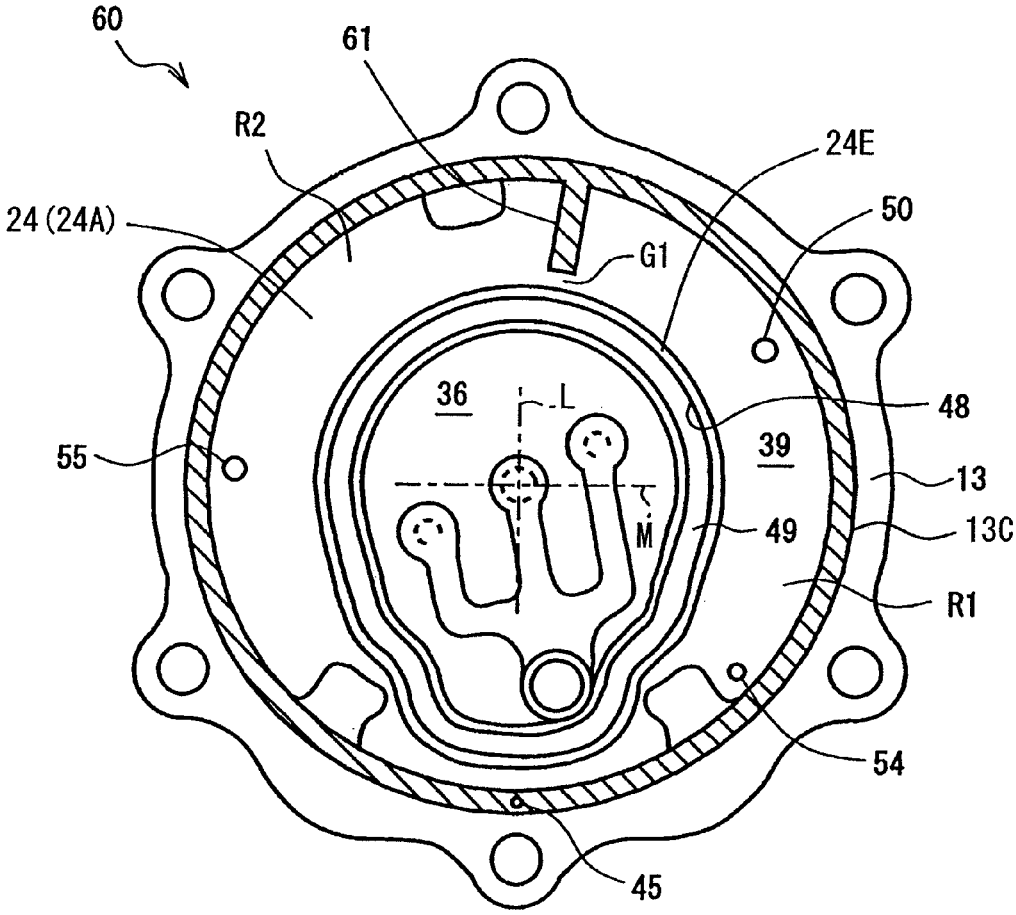
FIG. 5 is a cross-sectional view similar to FIG. 2, but shown a scroll type compressor according to a second preferred embodiment of the present invention.
Figure 6:
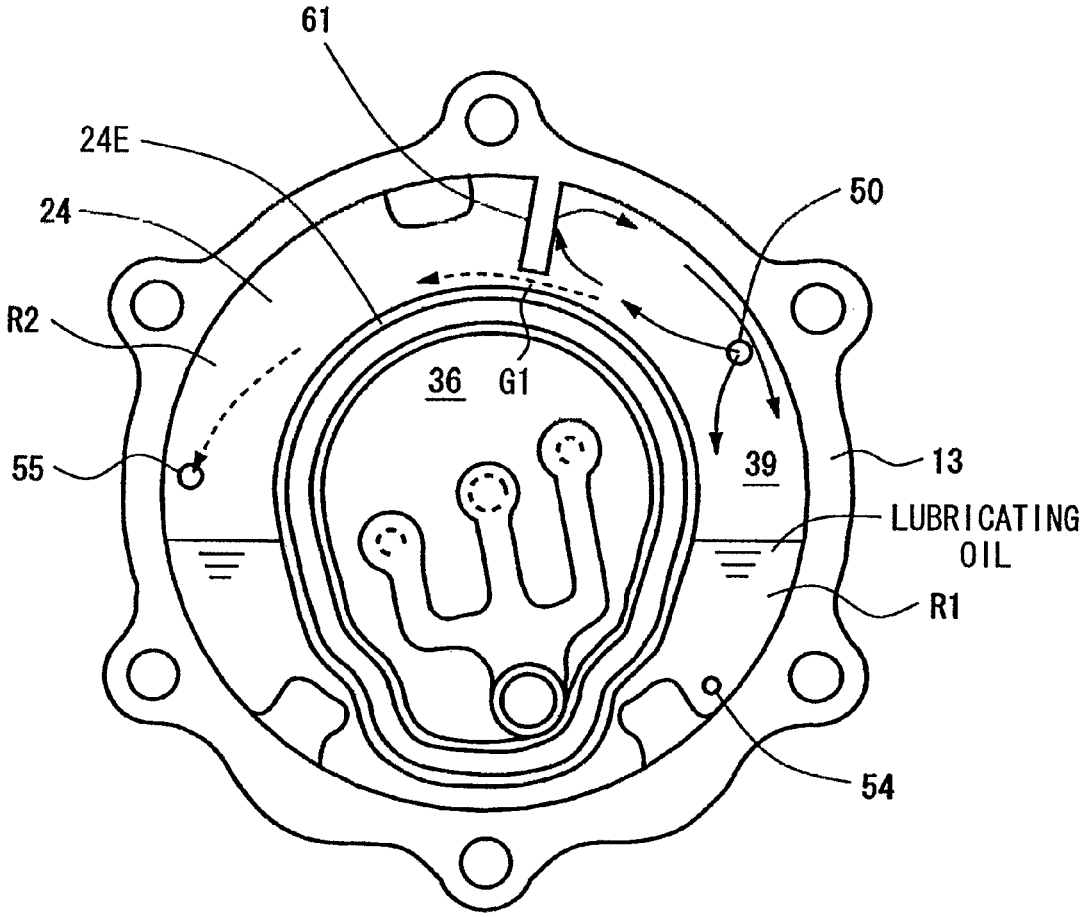
FIG. 6 is a schematic view illustrating the operation of the compressor according to the second preferred embodiment of the present invention.

The following describe a compressor according to a second preferred embodiment of the present invention with reference to FIGS. 5 and 6. The compressor of the second preferred embodiment differs from that of the first embodiment in that the partition wall 61 is modified over the counterpart 56 of the first preferred embodiment, but the rest of the structure of the compressor of the second embodiment is substantially the same as that of the first embodiment. For the sake of convenience of explanation, like or same parts or elements will be referred to by the same reference numerals as those which have been used in the first embodiment, and the description thereof will be omitted.

Referring to FIG. 5, the partition wall 61 of the second preferred embodiment is formed extending from the outer peripheral cylindrical portion 13C of the rear housing 13 toward the partition wall 24E. The outer peripheral cylindrical portion 13C of the rear housing 13 corresponds to the outer peripheral wall of the oil reservoir 39, and the partition wall 24E divides the inner space of the rear housing 13 into the discharge chamber 36 and the oil reservoir 39. The partition wall 61 extends only to such an extent that a clearance G1 is formed between the distal end of the partition wall 61 and the partition wall 24E. As shown in FIG. 6, lubricating oil jetted upward from the opening of the oil extraction passage 50 is dispersed such that the path of the lubricating oil draws a line extending toward the outer periphery of the oil reservoir 39 by centrifugal force acting on the lubricating oil. Thus, the lubricating oil impinges on the outer periphery of the partition wall 61 and then moves downward along the inner surface of the outer periphery of the oil reservoir 39 as indicated by an arrow in FIG. 6. As a result, the lubricating oil is collected in the oil reservoir 39 at the bottom thereof.

Meanwhile, lubricating oil jetted upward from the opening of the oil extraction passage 50 contains a small amount of refrigerant gas. Since the centrifugal force acting on the refrigerant gas is smaller than the centrifugal force that acting on the lubricating oil, the refrigerant gas moves along the inner surface of the oil reservoir 39 on the side adjacent to the discharge chamber 36. The clearance G1 is formed between the partition wall 61 and the inner surface of the oil reservoir 39 on the side adjacent to the discharge chamber 36. Thus, refrigerant gas moves toward the opening of the flow passage 55 through the clearance G1 and is introduced into the suction chamber 32 through the opening of the flow passage 55. Thus, the clearance G1 allows only refrigerant gas to flow directly into the opening of the flow passage 55 while preventing direct flowing of lubricating oil into the flow passage 55.

The present invention is not limited to the embodiments described above but it may be modified into various alternative embodiments as exemplified below.

Figure 8:
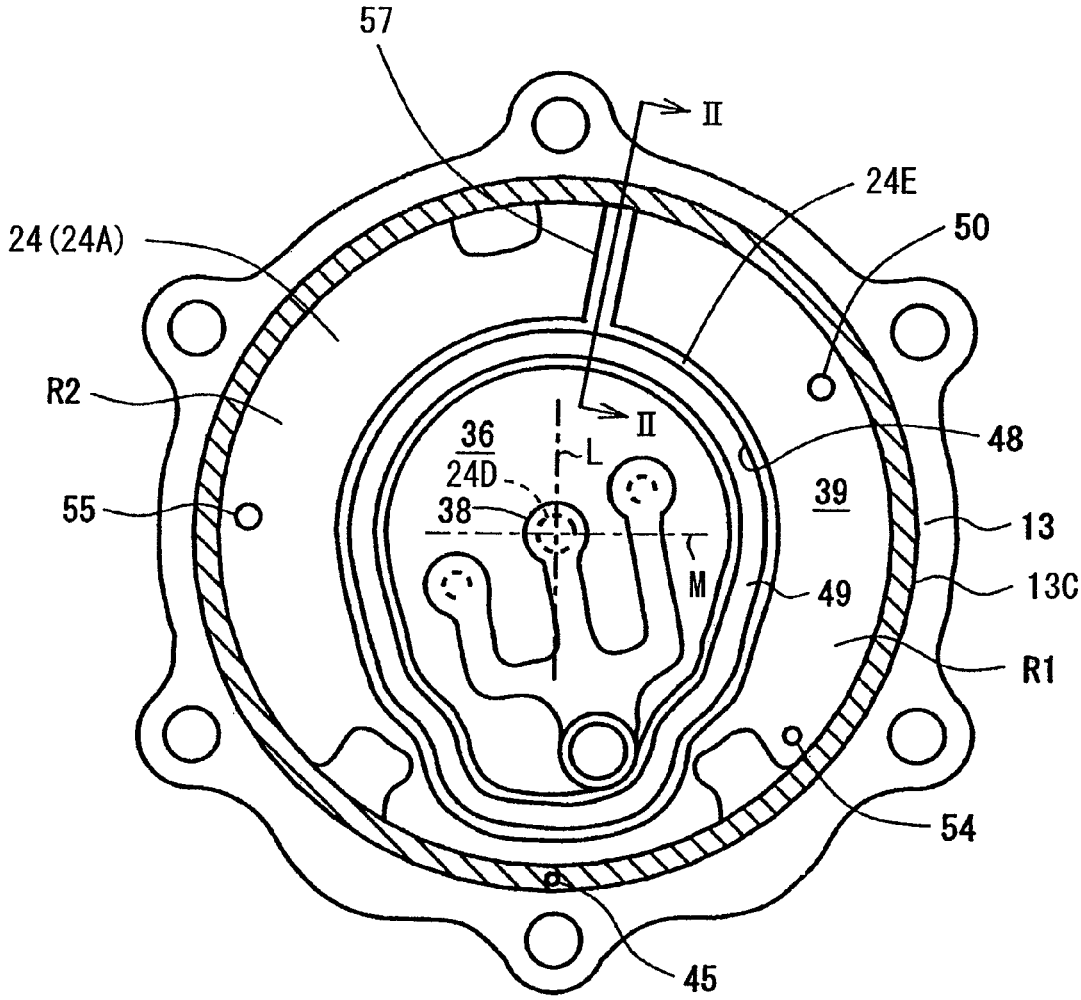
FIG. 8 is a transverse cross-sectional view similar to FIG. 2, but shown a scroll type compressor according to another embodiment of the present invention.

According to the first preferred embodiment, the partition wall 56 is formed extending from an outer peripheral wall of the oil reservoir 39. Alternatively, partition wall 57 may be formed extending from the partition wall 24E dividing into the discharge chamber 36 and the oil reservoir 39, and the distal end of the partition wall 57 may be in contact with an outer peripheral wall of the oil reservoir 39, as shown in FIG. 8.

Figure 9:
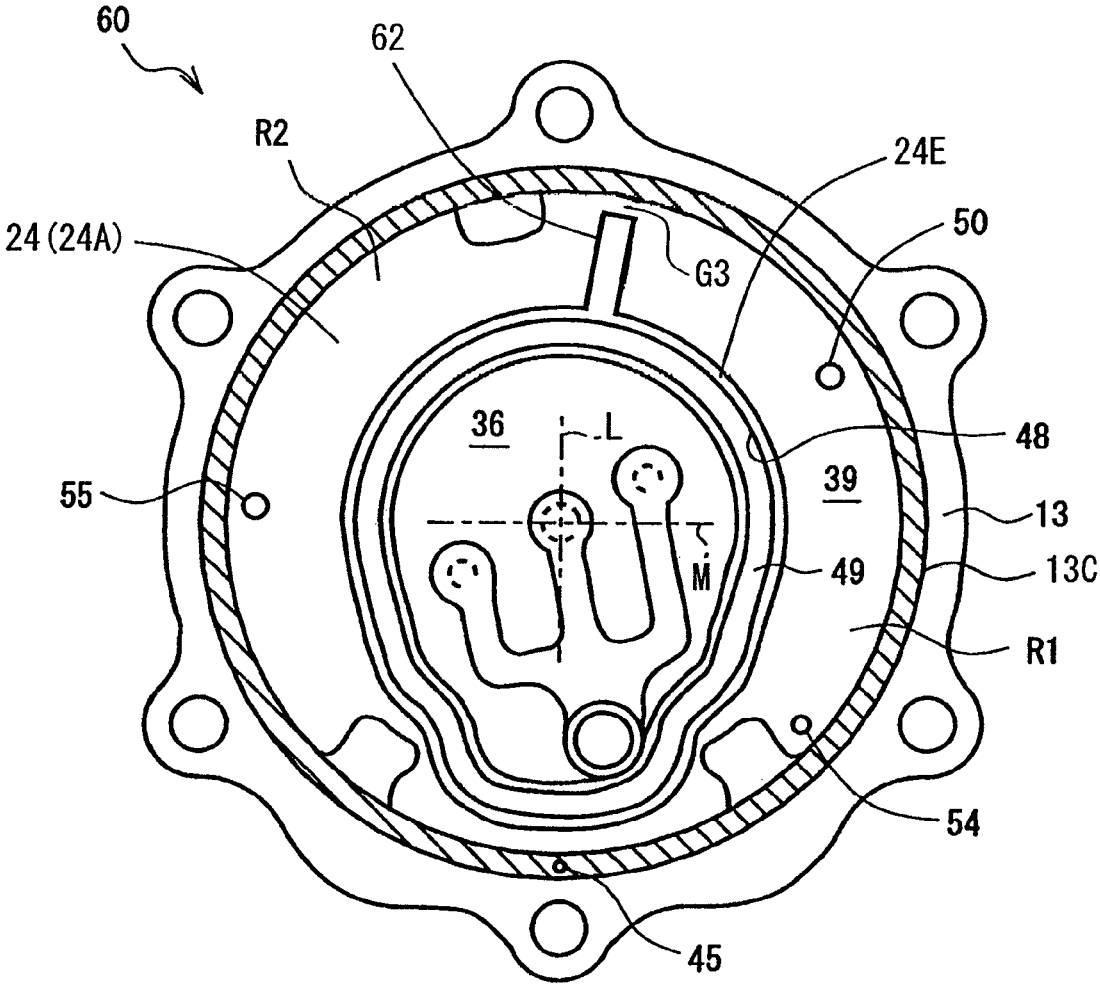
FIG. 9 is a cross-sectional view similar to FIG. 5, but shown a scroll type compressor according to another embodiment of the present invention.

According to the second preferred embodiment, the partition wall 61 is formed extending from an outer peripheral wall of the oil reservoir 39. Alternatively, partition wall 62 may be formed extending from the partition wall 24E, and a clearance G3 may be formed between the distal end of the partition wall 62 and the partition wall 24E, as shown in FIG. 9.

According to the first and second preferred embodiments, the partition walls 56, 61 are formed integrally with the rear housing 13. Alternatively, the partition walls 56, 61 may be formed integrally with the fixed scroll member 24 or formed separately and fixed to the rear housing 13 or to the fixed scroll member 24.

Figure 7:
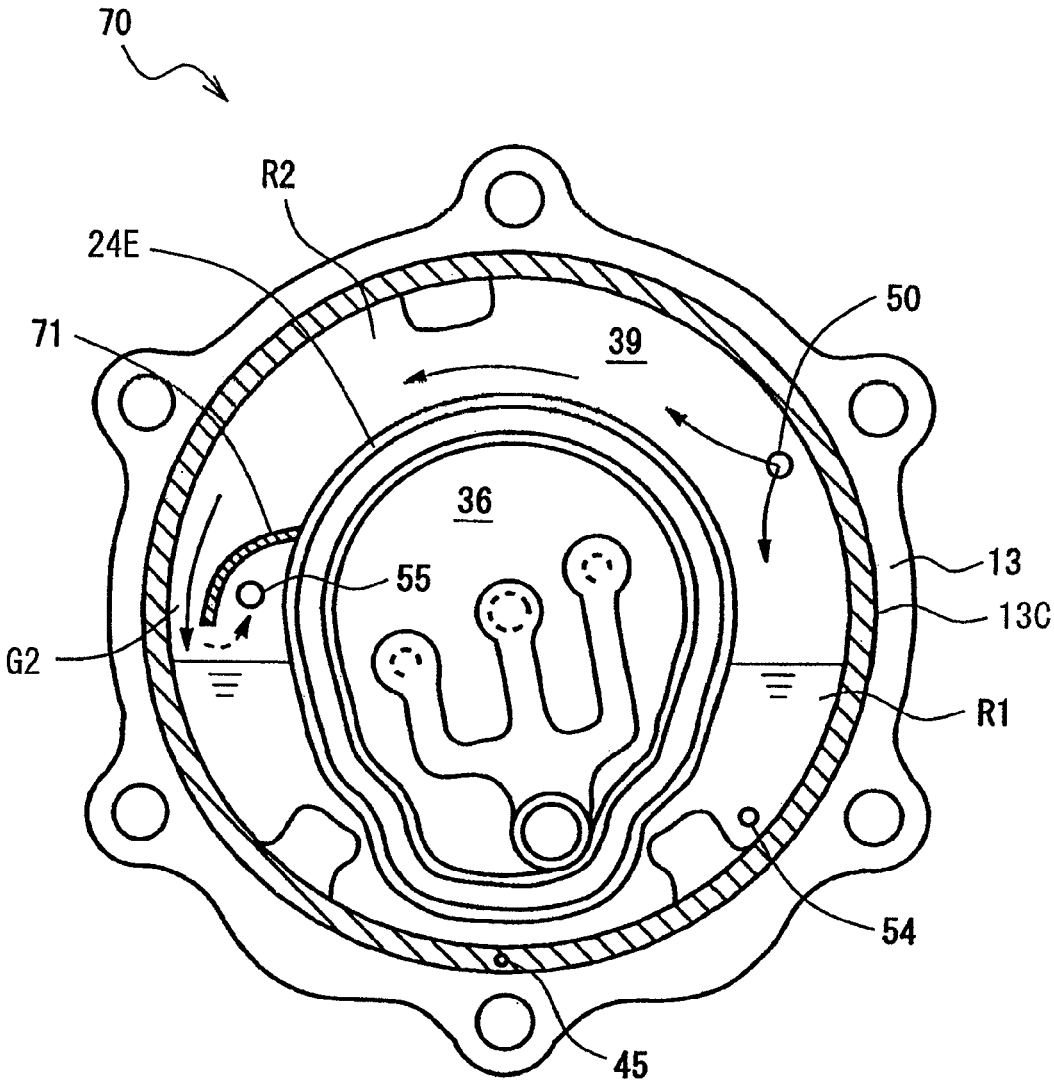
FIG. 7 is a cross-sectional view of a scroll type compressor according to another embodiment of the present invention.

The partition wall may be formed in an arcuate shape extending from the inner surface of the oil reservoir 39 on the side of the discharge chamber 36 so as to overhang the opening of the flow passage 55, such as the partition wall 71 shown in FIG. 7. A clearance G2 may be formed between the distal end of the partition wall 71 and the inner surface of the oil reservoir 39 on the side of the outer periphery thereof. In this case, lubricating oil jetted upward from the opening of the oil extraction passage 50 is dispersed so as to move in the counter-clockwise direction, as shown in FIG. 7. Then, the lubricating oil passes through the region R2 and the clearance G2, moves past the clearance G2 and is collected in the oil reservoir 39 at the bottom thereof. Refrigerant gas in the lubricating oil is separated therefrom, and flowed into the flow passage 55.

Figure 10:
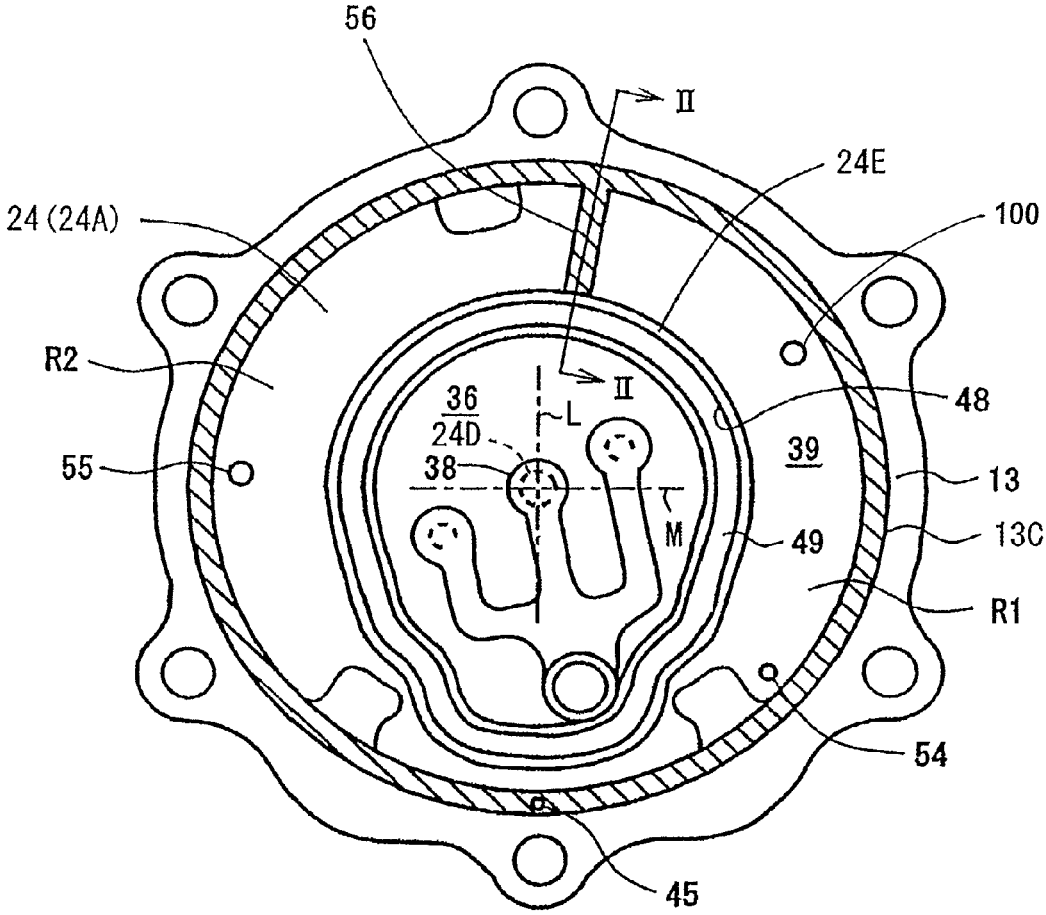
FIG. 10 is a transverse cross-sectional view similar to FIG. 2, but shown a scroll type compressor according to another embodiment of the present invention.

The regulating valve 51 provided in the oil extraction passage 50 according to the first and second preferred embodiments may be substituted by a valve with a fixed throttle 100 (see FIG. 10). Alternatively, the regulating valve or the fixed throttle may be provided in the communication passage 46 or the communication passage 45 which connects the oil reservoir 44 to the back-pressure chamber 35.

What is claimed is:

1. A scroll type compressor having a housing, a rotary shaft, a discharge chamber and a suction chamber comprising:

a fixed scroll member fixed to the housing;

a movable scroll member compressing refrigerant gas flowed from the suction chamber by the orbital movement of the movable scroll member due to the rotation of the rotary shaft and discharging the compressed refrigerant gas, and disposed in facing relation to the fixed scroll member;

an oil reservoir collecting lubricating oil, and disposed in the housing;

a back-pressure chamber in communication with the discharge chamber, and disposed behind the movable scroll member;

an oil extraction passage connecting the back-pressure chamber to the oil reservoir, and having a regulating valve or a throttle;

an oil return passage connecting the oil reservoir to the suction chamber;

a flow passage connecting the oil reservoir to the suction chamber, and introducing excess lubricating oil into the suction chamber when the level of lubricating oil in the oil reservoir becomes higher than a predetermined level; and a partition wall disposed in the oil reservoir between an opening of the oil extraction passage and an opening of the flow passage for restricting lubricating oil from the oil extraction passage other than the excess lubricating oil collected in the oil reservoir from flowing to the flow passage.

2. The scroll type compressor according to claim 1, wherein the oil reservoir having an annular space is formed in the housing so as to surround the discharge chamber, wherein the partition wall is disposed in the annular space other than an opening of the oil return passage.

3. The scroll type compressor according to claim 2, wherein the partition wall extends from a wall dividing into the discharge chamber and the oil reservoir, and a distal end of the partition wall is in contact with an outer peripheral wall of the oil reservoir.

4. The scroll type compressor according to claim 2, wherein the partition wall extends from an outer peripheral wall of the oil reservoir, and a distal end of the partition wall is in contact with a wall dividing into the discharge chamber and the oil reservoir.

5. The scroll type compressor according to claim 2, wherein the opening of the flow passage is located above the opening of the oil return passage, wherein the opening of the flow passage is located below the partition wall.

6. The scroll type compressor according to claim 2, wherein the partition wall extends from a wall dividing into the discharge chamber and the oil reservoir, and a clearance is formed between a distal end of the partition wall and an outer peripheral wall of the oil reservoir.

7. The scroll type compressor according to claim 2, wherein the partition wall extends from an outer peripheral wall of the oil reservoir, and a clearance is formed between distal end of the partition wall and a wall dividing into the discharge chamber and the oil reservoir.

8. The scroll type compressor according to claim 6, wherein the partition wall is formed in an arcuate shape extending from an inner surface of the oil reservoir on the side of the discharge chamber so as to overhang the opening of the flow passage.

9. The scroll type compressor according to claim 1, wherein the flow passage is formed at a position that is on the opposite side of a vertical line passing through a center of the oil reservoir from the oil extraction passage, and formed at a position that is higher than a horizontal line passing through the center of the oil reservoir, wherein the oil return passage is formed at a position below the horizontal line.

* * * * *